US009677769B2

(12) United States Patent
Laessig

(10) Patent No.: US 9,677,769 B2
(45) Date of Patent: Jun. 13, 2017

(54) FLEXIBLE SEQUENCE CONTROL AND METHOD FOR AUTOMATED CLEANING SYSTEM OF A COOKING DEVICE

(71) Applicant: Convotherm Elektrogeraete Gmbh, Eglfing (DE)

(72) Inventor: Hannes Laessig, Munich (DE)

(73) Assignee: CONVOTHERM ELEKTROGERAETE GMBH, Eglfing (DE)

( * ) Notice: Subject to any disclaimer, the term of this patent is extended or adjusted under 35 U.S.C. 154(b) by 520 days.

(21) Appl. No.: 13/755,685

(22) Filed: Jan. 31, 2013

(65) Prior Publication Data

US 2013/0199511 A1 Aug. 8, 2013

Related U.S. Application Data

(60) Provisional application No. 61/594,279, filed on Feb. 2, 2012.

(51) Int. Cl.
*F24C 14/02* (2006.01)
*F24C 15/00* (2006.01)
(Continued)

(52) U.S. Cl.
CPC ..... *F24C 14/00* (2013.01); *F24C 7/085* (2013.01); *F24C 14/005* (2013.01)

(58) Field of Classification Search
CPC ..... F24C 14/00; F24C 14/005; F24C 14/02; F24C 14/0205; F24C 14/025
(Continued)

(56) References Cited

U.S. PATENT DOCUMENTS 6,460,069 B1 * 10/2002 Berlin et al. ..... 709/201
2009/0178664 A1 * 7/2009 Valentine et al. ..... 126/21 A
(Continued)

FOREIGN PATENT DOCUMENTS

DE 102007005484 A1 7/2008
DE 102007019169 A1 10/2008
(Continued)

OTHER PUBLICATIONS

Extended European Search Report dated May 31, 2013 for European application No. 13000515.0.

*Primary Examiner* — Avinash Savani
*Assistant Examiner* — Vivek Shirsat
(74) *Attorney, Agent, or Firm* — Ohlandt, Greeley, Ruggiero & Perle, LLP

(57) ABSTRACT

Disclosed is a cooking device having a flexible sequence control for automatic cleaning of an oven cavity. A customizing aspect allows for the inputting of values for a combination of parameters of a cleaning system. These parameters may include degree of soiling, cleaning time, energy consumption, water consumption, cleaner consumption, rinse agent consumption, and/or overall cost of cleaning. The sets of parameters can be entered, saved and recalled, or deleted. While setting values of the parameters, any undefined parameter(s) are automatically changed accordingly to achieve an optimal result. Unreasonable or impossible combinations of parameters are blocked. The parameters may be visualized as user friendly touch-activated bars. Selection can be made from several optimizing options, such as cost optimization, time optimization, resource optimization, and ecological optimization that reduce the consumption of resources.

24 Claims, 4 Drawing Sheets

(51) Int. Cl.
*F24C 14/00* (2006.01)
*F24C 7/08* (2006.01)

(58) Field of Classification Search
USPC ..... 126/369, 19 R, 21 A, 273 R
See application file for complete search history.

(56) References Cited

U.S. PATENT DOCUMENTS

| | | | | |
|---|---|---|---|---|
| 2010/0294321 | A1* | 11/2010 | Rosenbauer | A47L 15/0005 134/25.2 |
| 2011/0283216 | A1* | 11/2011 | Buyuktopcu | 715/771 |
| 2012/0031432 | A1* | 2/2012 | Beaudet et al. | 134/18 |

FOREIGN PATENT DOCUMENTS

| | | | |
|---|---|---|---|
| DE | 102008014007 | A1 | 9/2009 |
| EP | 1473521 | A1 | 11/2004 |
| EP | 1659341 | A1 | 5/2006 |
| EP | 1717518 | A1 | 11/2006 |
| EP | 1953457 | A1 | 8/2008 |
| EP | 1953458 | A1 | 8/2008 |
| EP | 2211116 | A1 | 7/2010 |
| EP | 2273200 | A1 | 1/2011 |

* cited by examiner

FLEXIBLE SEQUENCE CONTROL AND METHOD FOR AUTOMATED CLEANING SYSTEM OF A COOKING DEVICE

CROSS-REFERENCED APPLICATION

This application claims priority to U.S. Provisional Application No. 61/594,279, filed on Feb. 2, 2012, which is incorporated herein in its entirety by reference thereto.

BACKGROUND

1. Field of the Disclosure

This disclosure relates to a cooking device with a controller and a method for automatic cleaning of a cooking device.

2. Discussion of the Background Art

Currently, automated cleaning systems are a common feature for the oven cavity of a hot air steaming oven ("hot-air-steamers"). Different automated cleaning systems for hot-air-steamers are described in EP1473521, EP1717518 and EP1953458. Each of these cleaning systems does not offer an interaction allowing the operator to vary or freely set the parameters of the cleaning sequence besides the choice of a preset soiling level.

There is a current cleaning system that takes into account the cooking operations since the last cleaning cycle and is able to recommend a cleaning sequence according to a calculated degree of soiling. Another current cleaning system offers a "green spirit" option that allows: (a) skipping the drying step after cleaning, (b) skipping the rinsing step, or (c) reducing the amount of water used. However, none of these systems allows for setting these parameters, by an operator or automatically through other commands, according to needs or demands for the use of the hot-air-steamer.

Also known is a cleaning system as described in EP 1953457. In EP '457, disclosed is an automated cleaning process for removing dirt, lime and/or corrosion that depends on a degree of soiling. The degree of soiling appears to be determined automatically with the use of a turbidity sensor. Once the degree of soiling is determined, a number of cleaning "points", i.e., times for repeated cleaning cycles represented by a first time $t_1$ and a second time $t_2$, are initiated. EP '457 describes a complete automated cleaning sequence to include (1) temperature at which the dirt is burned, (2) duration of the burning process to determine the degree of soiling, (3) determining a first quantity by a temperature profile with a number of cleaning points being assigned to each value of the temperature during the period of time between $t_1$ and $t_2$, (4) creating a temperature profile and assigning a number of cleaning points to each temperature value, (5) the number of cleaning points is zero at $t_1$, (6) $t_2$ is determined by a threshold level of cleanliness, i.e. threshold number of cleaning points, etc. EP '457 also includes a general discussion about determining a cleaning process based upon quantities of time, temperature, mechanical action and chemical action, but does not appear to provide any description or discussion of initiating a cleaning cycle by an operator-controlled system or method using any one or more of these parameters.

SUMMARY

Hot-air-steamers have a wide diversity of operation profiles. In a restaurant with eight hours of daily operation, the duration of the cleaning sequence is not very important. For example, the duration of the cleaning sequence can be allowed to take several hours to achieve a desired cost reduction. In contrast, a quick service restaurant with 23 hours of operation has to clean a heavily soiled oven cavity in a short time. In this latter case, an increased consumption of detergents and other resources is acceptable, and often necessary. However, current cleaning systems do not offer any possibility for adaptation or change of the cleaning sequence by the operator to meet such demands or needs. Moreover, the current systems do not offer control or monitoring of cleaning costs, also by the input(s) of the operator.

Thus, there is a need for control and a method that allows for adaption or change of a cleaning sequence by the operator of a cooking device to the needs of a restaurant or other facility. The ability to control and allow for the adaptation of a cleaning sequence provides for any one or more of a number of benefits. These include performing a more efficient cleaning sequence, thus ensuring that for any situation, the use of resources (e.g., both natural resources and/or cleaners/rinse agents) and and/or cleaning speed and/or cleaning effectiveness can be optimized. Also, it would be helpful to have a system and method where previously used and stored cleaning sequences that have been successful may be repeated. Ideally, once an operator has effected a proper cleaning cycle for a set of given conditions, it would be helpful to have a controller mechanism store and be able to recall such cycles. This can be accomplished if the controller has a "learning" function/ability, and is able to accurately repeat and/or be quickly modified from a "remembered" cleaning cycle to take into account changes in the degree of soil in the cleaning cavity, the cost of the resources, etc., to maintain cleaning effectiveness while the cost, time, and the like are monitored by the operator.

The flexible sequence controller of the present disclosure is uniquely operated to control the cleaning process based upon desired changes in any one or more of time, temperature, mechanical action and chemical action desired by the operator.

In a food cooking oven embodiment of the present disclosure, an oven for cooking food comprises: an oven cavity; a cleaning system that cleans said oven cavity; and a controller having a processor that executes instructions comprising: receiving values for a plurality of cleaning parameters; setting an optimization option for each said cleaning parameter; determining an optimization result for each said optimization option for each of said plurality of parameters; and displaying said optimization result.

In another embodiment of a food cooking oven of the present disclosure, the oven comprises an oven cavity, a cleaning system that cleans the oven cavity, a user interface and a controller wherein the user interface can be employed by a user to make adjustments to and control the outputs of the controller. The controller comprises a processor, a memory and a program module stored in the memory. The processor executes instructions of the program module to perform operations that comprise: presenting on the user interface a plurality of cleaning parameters for a user to assign values to a set of two or more of the plurality of parameters; presenting on the user interface a plurality of optimization options for the set of parameters for the user to select one of the optimization options; processing the selected optimization option to determine an optimization result for the plurality of parameters; and presenting on the user interface a message containing the result.

In an embodiment of the method of the present disclosure, the method allows for customizing a cleaning procedure for a cooking oven that comprises: an oven cavity; a cleaning system that cleans said oven cavity; and a controller having a processor which executes instructions comprising: receiving values for a plurality of cleaning parameters; setting an optimization option for each said cleaning parameter; determining an optimization result for each said optimization option for each of said plurality of parameters; and displaying said optimization result. The parameters may include degree of soiling in the oven cavity, duration of cleaning, energy consumption, water consumption, cleaner consumption, rinse agent consumption and the costs for the cleaning program. The parameters may include all or some of these parameters and/or other parameters. For example, cleaning temperature, fan speed, water pressure and water hardness parameters can be adjusted by the controller based upon operator-selected values and added to the parameter set. That is, the controller can be set to the values of all parameters that are important to cleaning the oven cavity given any particular situation. In the cleaning process, the controller controls, inter alia, a cleaner dosing pump, a rinse agent dosing pump, a drain pump, a circulating pump and water inlet valve in a sequence to clean the oven cavity.

In another embodiment of the method of the present disclosure, the method allows for customizing a cleaning procedure for a cooking oven that comprises an oven cavity, a cleaning system that cleans the oven cavity, a user interface, wherein the user interface can be adjusted by a user to control the controller, and a controller comprising a processor, a memory and a program module stored in the memory. The method comprises: operating the processor to execute instructions of the program module to perform steps comprising: presenting on the user interface a plurality of cleaning parameters for a user to assign values to a set of two or more of the plurality of parameters; presenting on the user interface a plurality of optimization options for the set of parameters for the user to select one of the optimization choices; processing the selected optimization option to determine an optimization result for the plurality of parameters; and presenting on the user interface a message containing the result.

The determination of whether a cleaning cycle needs to be performed can be carried out in several ways. The operator can view the degree of soil in the oven cavity and make that determination, the controller can suggest that cleaning be performed based upon any number of variables such as: the number of cooking cycles which have been carried out since the last cleaning; the temperatures over which a number of cooking cycles have been performed since the last cleaning; the duration of the cleaning cycles which have been carried out since the last cleaning; and the like. Also, the controller can automatically begin a cleaning cycle by determining the actual degree of soil in the oven cavity. The controller may make this automatic determination using any of the methods and or devices for doing so which are described in the prior art and known to those skilled in the art. In any event, the controller and related components of the present disclosure allow for the operator to vary the cleaning cycle based on adjusting any one or more of the parameters which are of importance to the operator for any particular cleaning cycle, as described herein in more detail below. Also, the controller may present to the operator a choice between two or more different overall options for the end result of the cleaning cycle, such as "water saving cleaning cycle", "minimal time cleaning cycle", "minimum temperature cleaning cycle", "cost optimized cleaning cycle" and the like. Of course in any event, the controller and related components of the present disclosure allow for the operator to vary the cleaning cycle based on adjusting any one or more of the parameters which are of importance to the operator for any particular cleaning cycle, as described herein in more detail below.

BRIEF DESCRIPTION OF THE DRAWINGS

Other and further objects, advantages and features of the present disclosure will be understood by reference to the following specification in conjunction with the accompanying drawings, in which like reference characters denote like elements of structure, wherein.

DETAILED DESCRIPTION OF THE PREFERRED EMBODIMENT

Figure 1:
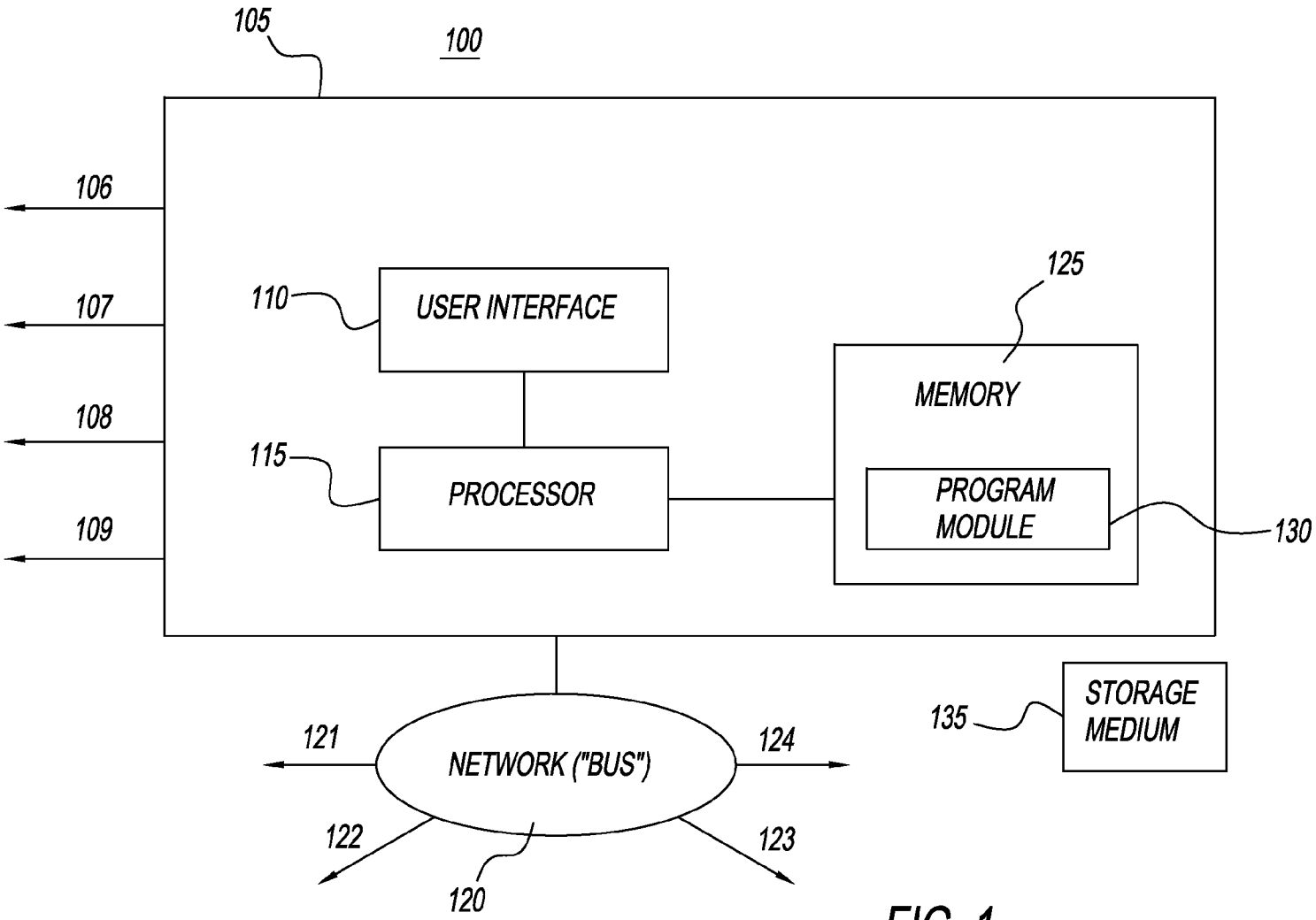
FIG. 1 is a schematic block diagram of a controller system of the present disclosure.

Referring to FIG. 1, system 100 includes controller 105 coupled to the various electric devices such as heaters, fans, valves, pumps and the like via individual direct or coupled connections, e.g., 106, 107, 108, 109 or through a "network" 120, e.g., a "bus", via connections, e.g., 121, 122, 123, 124. Controller 105 includes user interface 110, processor 115, and memory 125. Controller 105 may be implemented on a general-purpose microcomputer. Although controller 105 is represented herein as a standalone device, it is not limited to such, but instead can be coupled to other devices (not shown) as described above, via network 120.

Processor 115 is configured of logic circuitry that responds to and executes instructions. Memory 125 stores data and instructions for controlling the operation of processor 115. Memory 125 may be implemented in a random access memory (RAM), a hard drive, a read only memory (ROM), or a combination thereof. One of the components of memory 125 is program module 130. Program module 130 contains instructions for controlling processor 115 to execute the methods described herein. For example, as a result of execution of program module 130, processor 115 presents on user interface 110 a plurality of cleaning parameters for a user to assign values to a set of two or more of the plurality of cleaning parameters; presents on user interface 110 a plurality of optimization options for the set of parameters for the user to select one of the optimization options; processes the selected optimization option to determine an optimization result for the plurality of cleaning parameters; and presents on user interface 110 a message containing the result. The term "module" is used herein with respect to program module 130 to denote a functional operation that may be embodied either as a stand-alone component or as an integrated configuration of a plurality of sub-ordinate components. Thus, program module 130 may be implemented as a single module or as a plurality of modules that operate in cooperation with one another. Moreover, although program module 130 is described herein as being installed in memory 125, and therefore being implemented in software, it could be implemented in any of hardware (e.g., electronic circuitry), firmware, software, or a combination thereof.

User interface 110 includes an input device, such as a keyboard or speech recognition subsystem, for enabling a user to communicate information and command selections to processor 115. User interface 110 also includes an output device such as display or a printer. A control for the cleaning parameters presented on user interface 110 such as a touch screen, levers, or dials allows the user to manipulate the cleaning parameters for communicating additional information and command selections to processor 115. Processor 115 outputs, to user interface 110, a result of an execution of the methods described herein. Alternatively, processor 115 could direct the output to a remote device (not shown) via network 120 (connections to remote device not shown).

While program module 130 is indicated as already loaded into memory 125, it may be configured on storage medium 135 for subsequent loading into memory 125. Storage medium 135 can be any conventional storage medium that stores program module 130 thereon in tangible form. Examples of storage medium 135 include a floppy disk, a compact disk, a magnetic tape, a read only memory, an optical storage media, universal serial bus (USB) flash drive, a digital versatile disc, or a zip drive. Alternatively, storage medium 135 can be a random access memory, or other type of electronic storage, located on a remote storage system and coupled to controller 105 via network 120.

Processor 115 executes instructions of program module 130 to present on user interface 110 a request for the user to input local prices for energy (electricity and/or gas) water and cleaning detergents to be used. These parameters are stored in memory 125.

Figure 2:
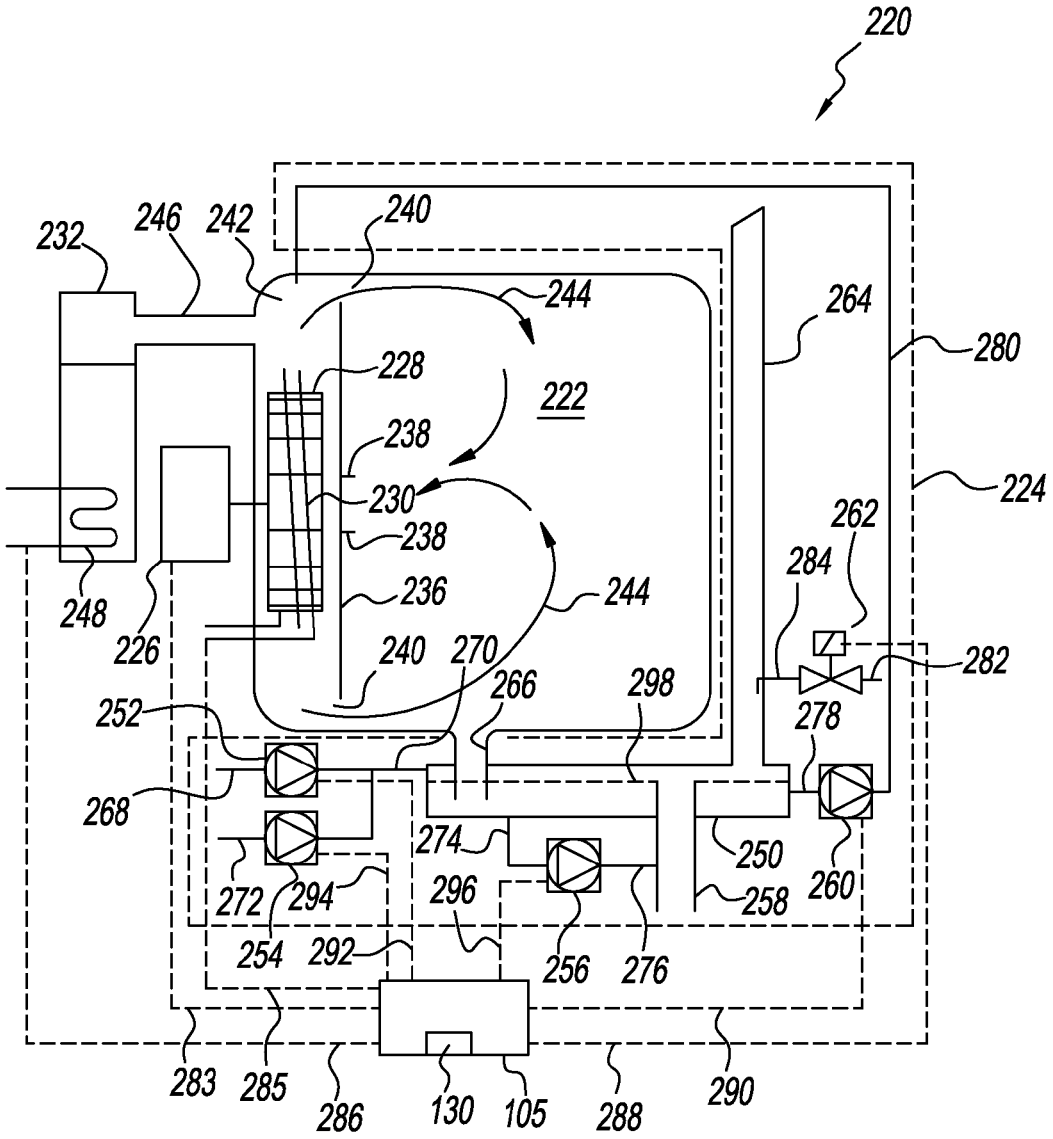
FIG. 2 is a block diagram of a cooking device according to the present disclosure.

FIG. 2 is a block diagram of a cooking device 220. After using cooking device 220 to prepare food, there is a need to clean cooking device 220. The user activates the program module 130 by selecting that action from a menu on a touch screen of user interface 110. Processor 115 executes instructions of program module 130 to present on user interface 110 a request for the user to input preferred parameters and values for two or more of the parameters. For example, if the soiling of cooking device 220 is quite heavy and there is a need to prepare more food soon, the user opts for a high soiling level and a short cleaning time (e.g., 40 minutes).

Processor 115 then executes instructions of program module 130 to present on user interface 110 a plurality of optimization options. There are several optimization options the user can choose. For example if the user chooses to optimize price-wise, optimized values for the balance of consumption of water, energy and detergents are calculated to achieve a minimum of costs that result in an acceptable cleaning result. If the user, on the other hand, chooses to optimize the energy consumption, the cleaning temperature will be reduced and the dosing of detergent increased to reach good results with less energy.

Processor 115 executes instructions of program module 130 to process the optimization option selected by the user and to present on user interface 110 the optimization result for the plurality of parameters. The result can be either a presentation of optimized values for the plurality of parameters or may indicate a conflict in the parameter values chosen by the user. If, for example, the detergent use is set to a high level and the cleaning costs are set low, program module 130 may refuse to accept the user entered values. As the cost of detergents is a big cost driver, this conflict cannot be resolved. Instead, the result is a message that explains the conflict.

Figure 3:
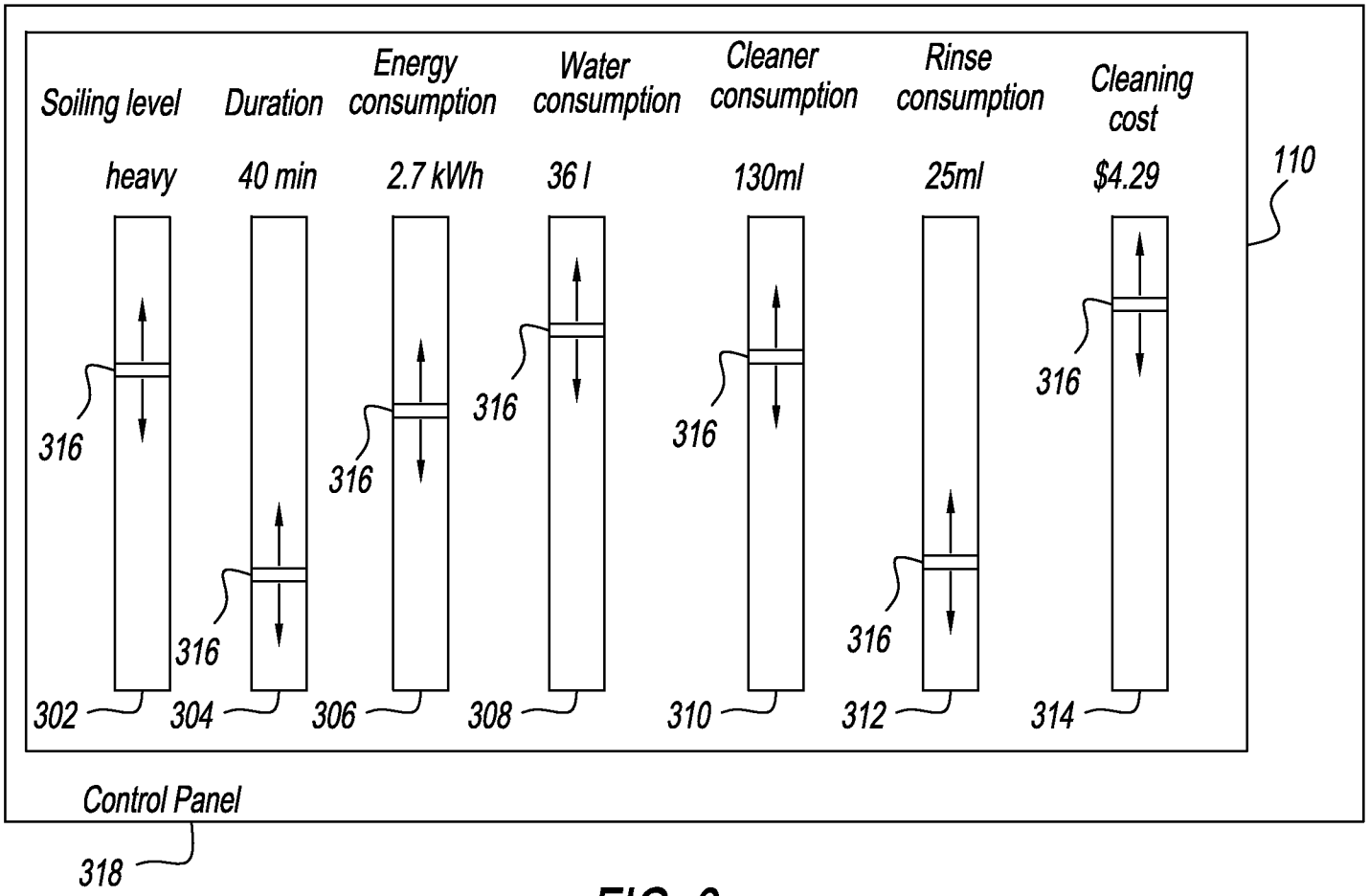
FIG. 3 is an illustration of a display of a set of parameters that can be presented to the operator or other user of the cooking device of FIG. 2.

FIG. 3 is an illustration of a display of a set of parameters. If there is no conflict in the user-entered parameters and values, the remaining parameters are adjusted to achieve an optimal cleaning result. An example of optimized values is shown above the bars in FIG. 3. In the example with heavy soiling and short cleaning time (i.e., short duration of the cleaning cycle), the water consumption, energy consumption and detergent consumption (i.e., cleaner consumption or quantity) are increased to clean heavily soiled cooking device 220 in a short time. If, additionally, the detergent consumption is set to a lower level, the energy consumption and water consumption will be increased to compensate. An input outside the range that cannot be compensated for by adjusting or varying free parameters will not be accepted by program module 130, as explained above.

The price calculations are based on local prices initially entered by the user. These can be updated as desired or necessary. For example cleaner costs may go down and water costs may go up. In combination with the planned consumptions of water, energy and detergents, a cleaning cost can be calculated for every acceptable set of parameters.

The parameter sets can be stored in memory 125 either prior to or after the cleaning process or procedure. Any parameter set can be recalled from memory 125 for another cleaning cycle, and/or a recalled parameter set can be adjusted once it is recalled. This could be the case in situation where a stored parameter set is close to what the operator wants to run, but the operator wants to make some adjustment(s) to it.

Program module 130 also allows the user to adjust the settings or values of the parameters. This allows, for example, for the operator to decrease the detergent consumption of a recalled parameter set before a cleaning process is performed on cooking device 220.

Processor 115 executes instructions of program module 130 to present on user interface 110 a cleaning result rating feature. If the user is satisfied with the cleaning result that uses the changed parameter value, processor 115 stores the adjusted parameter set. This simplifies finding an optimal cleaning sequence for operators faced with repeated similar degrees of soiling. Likewise, a parameter set which results in a non-optimal cleaning result may be deleted from memory 125.

Another possible feature of the present disclosure is a self-learning function. As noted above, a cleaning result feature is presented on user interface after a cleaning process is completed. The operator is asked to rate the cleaning result after the cleaning process. If, for example, the cleaning result is not satisfying, the recommendation of detergent consumption can be increased. That way, for example, a lower detergent efficiency due to the local water quality can be compensated.

Referring to FIG. 2, cooking device 220 comprises oven cavity 222, cleaning system 224, fan motor 226, fan 228, heater 230, steam generator 232 to produce steam for cooking, and controller 105. In an alternate embodiment, steam for cooking can be produced by spritzing or flashing water on a hot surface. Baffle plate 236 is located on the low pressure side of fan 228 to form fan box 242. Baffle plate 236 has one or more central opening 238 and one or more peripheral openings 240 between the periphery of baffle plate 236 and a top and a bottom of oven cavity 222 and optionally one or more sides of oven cavity 222. Heater 230 is shown as an electrical heating element that is located about the periphery of fan 228. One or more food trays (not shown) may be disposed on supports (not shown) to hold food products (not shown) for cooking in oven cavity 222. In other embodiments, heater 230 may be a gas burner, an infrared heater and/or any other suitable heater.

Controller 105 operates fan motor 226 to drive fan 228 to circulate air between fan box 242 and oven cavity 222 via peripheral openings 240 (and, ultimately back to fan box via central opening(s) 238) as shown by arrows 244. Controller 105 operates a switch (not shown) that connects heater 230 to a source of electricity (not shown) so as to heat the circulating air. Controller 105 further controls steam generator 232 to inject steam via a fluid conduit 246 into fan box 242 and the circulating air. For example, steam generator 232 comprises a container that holds water supplied by a source (not shown). Heater 248 is disposed in the water. Controller 105 operates a switch (not shown) to connect the source of electricity (not shown) to heater 248 to heat the water to temperatures that produce the steam.

Cleaning system 224 comprises cleaner container 250, cleaner dosing pump 252, rinse agent dosing pump 254, drain pump 256, drain pipe 258, circulating pump 260, water inlet valve 262 and exhaust pipe 264. Cleaner container 250 is disposed below oven cavity 222. Oven cavity 222 comprises cavity drain conduit 266 that is in fluid communication with cleaner container 250.

Cleaner dosing pump 252 is connected by fluid conduits 268 and 270 between a source of cleaning fluid (not shown) and cleaner container 250. Rinse agent dosing pump 254 is connected by fluid conduits 272 and 270 between a source of rinsing fluid (not shown) and cleaner container 250.

Drain pump 256 is connected between cleaner container 250 and drain pipe 258 by fluid conduits 274 and 276. Circulating pump 260 is connected between cleaner container 250 and fan box 242 by fluid conduits 278 and 280. Water inlet valve 262 is connected between a source of water (not shown) and exhaust pipe 264 by fluid conduits 282 and 284.

Controller 105 is operable in a plurality of modes, which include a cooking mode and a cleaning mode. In the cooking mode, controller 105 controls fan motor 226 and heater 230 via electrical connection 283 and electrical connection 285, respectively, to provide a circulating heated air stream through fan box 242 and oven cavity 222 as denoted by arrows 244. Controller 105 also controls heater 248 via electrical connection 286 to heat the water in steam generator 232 to produce steam, which is injected into the circulating heated air stream in fan box 242 via fluid conduit 246.

During the cooking of food products, by-products, for example, juices, oils, particles and the like, fall into cleaner container 250 via cavity drain conduit 266. Drain pipe 258 extends into cleaner container 250 a distance to provide an overflow level 298. When the food by-products reach overflow level 298, they overflow into drain pipe 258. Controller 105 may operate water inlet valve 262 to provide water into cleaner container 250 for cooling down cleaning fluid in container 250.

In the cleaning mode, controller 105 controls cleaner dosing pump 252 via electrical connection 292, rinse agent dosing pump 254 via electrical connection 294, drain pump 256 via electrical connection 296, circulating pump 260 via electrical connection 290 and water inlet valve 262 via electrical connection 288, in a sequence to clean oven cavity 222 and cleaner container 250. In contrast to known oven cleaning systems, a program module 130 allows the operator to adjust values of a plurality of parameters to provide a customized combination of parameter values that meet the needs or demands of the use to which the oven is put. In other words, program module 130 provides a flexible sequence that is adjustable by the operator.

In a preferred embodiment, the parameters comprise degree of soiling in oven cavity 222, duration of cleaning, energy consumption/cleaning temperature, water consumption, cleaner consumption, rinse agent consumption and the costs for the cleaning program. In other embodiments, the parameters may include all or some of these parameters and/or other parameters. For example, cleaning temperature, fan speed, water pressure and water hardness parameters can be entered by the operator and added to the parameter set. That is, the operator can set the values of all parameters that are important to cleaning oven cavity 222 given any particular situation or desire of the operator. Program module 130 calculates a price or cost for each cleaning or set of parameter values that can be presented to the operator.

An operator-entered parameter combination or values thereof that is impossible or unwise is blocked. Optionally, a solution or recommendation can be presented to the operator for the otherwise blocked parameter combination of values thereof.

Any parameter(s) of the combination that are not set by the operator may be automatically adjusted as needed to reach an optimal result. The parameter values may be set discretely or continuously by the operator. For example, the operator defines one or more parameters (e.g., time—1 hour, and degree of soiling—high). Accordingly, the other parameters are changed by controller 105 to get a reasonable combination of parameters (e.g., to reach a good cleaning result, the amount of cleaner and rinse agent are increased as well as the temperature and the amount of water).

Program module 130 can additionally be provided a self-learning function. After each cleaning, the operator is asked to rate whether the result is satisfying or not. This rating is considered by the customizing feature for possible adjustment of the values of the "not-set" parameters.

Cleaning programs set by the operator can be stored and used again. A cleaning program is a complete step-by-step process of cleaning. It is described by a complete set of cleaning parameters.

Program module 130 can also allow the operator to select from a plurality of options for optimizing the parameter(s) set or combination thereof. These options, for example, may include all or some of cost optimization, time optimization, resource optimization, water consumption, cleaner consumption, rinse agent consumption, and ecological optimization that reduces the consumption of resources. It will be apparent to those of skill in the art that other options can be used.

Referring to FIG. 3, control panel 318 comprises user interface 110, which shows a bar presentation of a set of exemplary parameters including soiling level bar 302, duration bar 304, energy consumption bar 306, water consumption bar 308, cleaner consumption bar 310, rinse agent consumption bar 312 and cleaning costs bar 314. Each bar includes marker 316 that is adjustable by the operator (by any one of a number of actions) up or down as shown by the arrows, when prompted by program module 130. Markers 316 can be touch activated. For example, marker 316 of soiling level bar 302 can be adjusted by the operator up or down to set a soiling level value. Cleaning cost bar 314 shows a cost of $4.29 for a cleaning cycle using the values indicated by markers 316 in the other bars. Other visual presentations can be used. For example, other geometrical shapes as well as colors may be used.

Figure 4:
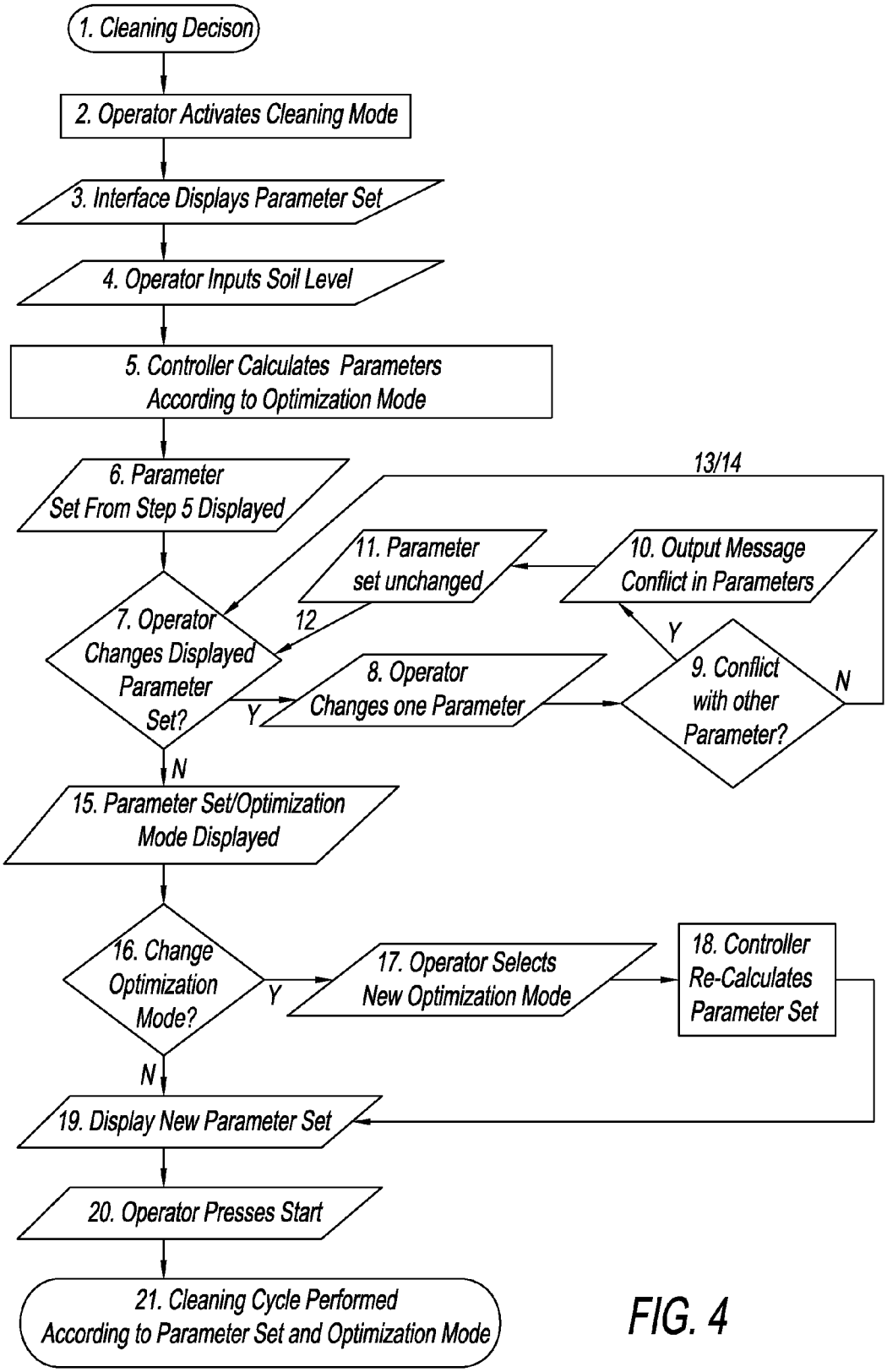
FIG. 4 is an exemplary flow chart showing the operation of a method and system of the present disclosure.

FIG. 4 is a flow chart of a step-wise example of a cleaning method using system 100.

1. Operator decides to clean oven cavity 222 of cooking device 220.
2. Operator activates the cleaning mode using user interface 110.
3. User interface 110 displays parameter sets available for the cleaning mode.

4. Operator manually inputs the soil level of oven cavity 222. For this example, from operator's visual observation, operator decides that oven cavity 222 is "heavily soiled".
5. Operator input of "heavily soiled" prompts controller 105 to calculate and display on user interface 110 a set of cleaning parameters fitting the "heavily soiled" soil level in respect of a default optimization mode (e.g., energy consumption).
6. The parameter set resulting from step 5 is displayed on user interface 110.
7. Operator now has the opportunity to change one or more of the displayed parameter set. If operator changes a parameter, proceed to step 8. If operator does not change a parameter, proceed to step 15.
8. Operator changes a parameter (e.g., cleaning time to 5 minutes) on user interface 110.
9. Controller 105 checks the parameter change made in step 8 for possible conflict in the overall parameter set (e.g., is it possible to clean a "heavily soiled" oven cavity in 5 minutes). If there is a conflict, proceed to step 10. If there is no conflict, proceed to step 13.
10. Since there is a conflict, a message is output on user interface 105 (e.g., "conflict between selected soil level and selected cleaning time").
11. The parameter set is not changed.
12. The operator is again free to change a parameter using user interface 110. (Note: if a dangerous or impossible parameter set is not changed in step 7 after step 12, controller 105 may "block" the selected parameter set and not allow the cleaning cycle to begin).
13. Since there is no conflict is recognized by controller 105 in the overall parameter set (e.g., operator increases cleaning time to 40 minutes from 30 minutes presented on interface in steps 5/6), controller 105 re-calculates an overall parameter set optimized according to the chosen or default optimization mode (e.g., for energy consumption optimization: detergent consumption, cleaning time, and cleaning temperature will all be altered accordingly).
14. The re-calculated overall parameter set is displayed on user interface 105, and the method loops back to step 7. (Note: after step 14, in the re-execution of step 7, one or more additional parameters may be changed or defined by operator. For each operator-changed or -defined parameter, the conflict check of steps 9-14 will be repeated by controller 105, and controller 105 re-calculates the overall parameter set.
15. Besides cleaning parameter sets, a choice of optimization modes is displayed on interface 110.
16. Operator has the option to change the optimization mode. If the operator wishes to change the optimization mode, proceed to step 17. If the operator does not wish to change the optimization mode, proceed to step 19.
17. Operator selects a new optimization mode. For example, operator may change the default setting (e.g., energy consumption) to another optimization mode (e.g., detergent consumption).
18. Controller 105 re-calculates the parameter set (e.g., detergent consumption reduced, cleaning temperature increased) to achieve an optimal result with respect to the optimization mode selected by the operator.
19. The resulting parameter set and optimization mode is displayed on user interface 110.
20. Operator reviews the parameter set and optimization mode of step 19, and if satisfied therewith, operator presses a start button on user interface 110.
21. The cleaning cycle is then performed in accordance with the parameter set and optimization mode.

The present disclosure having been thus described with particular reference to the preferred forms thereof, it will be obvious that various changes and modifications may be made therein without departing from the spirit and scope of the present disclosure as defined in the appended claims.

All of the patents and publications referred to herein are incorporated herein by reference as if fully set forth herein.

What is claimed is:

1. An oven comprising:
an oven cavity;
a cleaning system that cleans said oven cavity;
a user interface; and
a controller having a processor that executes instructions that cause said processor to perform operations of:
presenting, on the user interface, a plurality of cleaning parameters, wherein each of said plurality of cleaning parameters is scalable and individually adjustable by a user via the user interface;
receiving, via the user interface, values for at least two of the plurality of user-scalable and individually user-adjustable cleaning parameters for cleaning said oven cavity at the time of cleaning;
presenting, on user interface, a plurality of optimization options;
receiving, via the user interface, an optimization option;
determining an optimization result for the plurality of cleaning parameters using said received optimization option; and
displaying said optimization result for the plurality of cleaning parameters.

2. The oven of claim 1, wherein said optimization result is selected from the group consisting of: optimized values for said plurality of cleaning parameters, conflict recognition between two or more of said plurality of cleaning parameters, conflict avoidance recommendation for parameters in conflict, and combinations of any of the foregoing.

3. The oven of claim 1, wherein said optimization option is selected from the group consisting of: cost optimization, energy consumption optimization, time optimization, resource optimization, water consumption optimization, cleaner consumption optimization, rinse agent consumption optimization, and combinations of any of the foregoing.

4. The oven of claim 1, wherein said plurality of cleaning parameters is selected from the group consisting of: energy consumption, soiling level, time duration, water consumption, cleaner consumption, rinse agent consumption, cleaning cost, cleaning temperature, oven fan speed, water pressure, water hardness, and combinations of any of the foregoing.

5. The oven of claim 1, wherein said optimization result for the set of values of said plurality of cleaning parameters comprises optimized values for said plurality of cleaning parameters, and wherein said controller uses said optimized values to operate said cleaning system to perform a cleaning procedure to clean said oven cavity.

6. The oven of claim 5, wherein said operations further comprise:
presenting on said user interface an option for a user to adjust one of said optimized values to obtain an adjusted optimized value;
presenting on said user interface after said cleaning procedure is completed an option for said user to request saving said optimized values with said adjusted optimized value; and
storing said optimized values with said adjusted optimized value in a memory.

7. The oven of claim 6, wherein said operations further comprise:

presenting on said user interface a cleaning result rating feature; and presenting on said user interface a recommendation of changing one or more of said optimized values if said user enters a rating of unsatisfactory.

8. A method of customizing a cleaning procedure for an oven comprising:

an oven cavity;

a cleaning system that cleans said oven cavity;

a user interface; and a controller having a processor which executes instructions that cause said processor to perform operations of:

presenting, on the user interface, a plurality of cleaning parameters, wherein each of said plurality of cleaning parameters is scalable and individually adjustable by a user via the user interface;

receiving, via the user interface, values for at least two of the plurality of user-scalable and individually user-adjustable cleaning parameters for cleaning said oven cavity at the time of cleaning;

presenting, on user interface, a plurality of optimization options;

receiving, via the user interface, an optimization;

determining an optimization result for the plurality of cleaning parameters using said received optimization option; and displaying said optimization result for the plurality of cleaning parameters.

9. The method of claim 8, wherein said optimization result is selected from the group consisting of: optimized values for said plurality of cleaning parameters, conflict recognition between two or more of said plurality of cleaning parameters, conflict avoidance recommendation for parameters in conflict, and combinations of any of the foregoing.

10. The method of claim 8, wherein said optimization option is selected from the group consisting of: cost optimization, energy consumption optimization, time optimization, resource optimization, water consumption optimization, cleaner consumption optimization, rinse agent consumption optimization, and combinations of any of the foregoing.

11. The method of claim 8, wherein said plurality of cleaning parameters is selected from the group consisting of: energy consumption, soiling level, time duration, water consumption, cleaner consumption, rinse agent consumption, cleaning cost, cleaning temperature, oven fan speed, water pressure, water hardness, and combinations of any of the foregoing.

12. The method of claim 8, wherein said optimization result for the set of values of said plurality of cleaning parameters comprises optimized values for said plurality of cleaning parameters, and wherein said controller uses said optimized values to operate said cleaning system to perform a cleaning procedure to clean said oven cavity.

13. The method of claim 12, wherein said operations further comprise:

presenting on said user interface an option for a user to adjust one of said optimized values to obtain an adjusted optimized value;

presenting on said user interface after said cleaning procedure is completed an option for said user to request saving said optimized values with said adjusted optimized value; and storing said optimized values with said adjusted optimized value in said memory.

14. The method of claim 13, wherein said operations further comprise:

presenting on said user interface a cleaning result rating feature; and presenting on said user interface a recommendation of changing one or more of said optimized values if said user enters a rating of unsatisfactory.

15. A system for use in setting and performing automatic cleaning of a cooking device, said system comprising a user interface and a controller comprising a processor that executes instructions that causes the processor to perfume the operations of:

presenting, on the user interface, a plurality of cleaning parameters, wherein each of said plurality of cleaning parameters is scalable and individually adjustable by a user via the user interface;

receiving, via the user interface, values for at least two of the plurality of user-scalable and individually user-adjustable cleaning parameters for cleaning said oven cavity at the time of cleaning;

receiving, via the user interface, an optimization option;

determining an optimization result for the plurality of cleaning parameters using said received optimization option; and displaying said optimization result for the set of said plurality of cleaning parameters.

16. The system of claim 15, wherein said optimization result is selected from the group consisting of: optimized values for said plurality of cleaning parameters, conflict recognition between two or more of said plurality of cleaning parameters, conflict avoidance recommendation for the parameters in conflict, and combinations of any of the foregoing.

17. The system of claim 15, wherein said optimization option is selected from the group consisting of: cost optimization, energy consumption optimization, time optimization, resource optimization, water consumption optimization, cleaner consumption optimization, rinse agent consumption optimization, and combinations of any of the foregoing.

18. The system of claim 15, wherein said plurality of cleaning parameters is selected from the group consisting of: energy consumption, soiling level, time duration, water consumption, cleaner consumption, rinse agent consumption, cleaning cost, cleaning temperature, oven fan speed, water pressure, water hardness, and combinations of any of the foregoing.

19. The system of claim 16, wherein said optimization result for the set of values of said plurality of cleaning parameters comprises optimized values for said plurality of cleaning parameters, and wherein said controller uses said optimized values to operate said cleaning system to perform a cleaning procedure to clean said oven cavity.

20. The system of claim 19, wherein said operations further comprise:

presenting on said user interface an option for a user to adjust one of said optimized values to obtain an adjusted optimized value;

presenting on said user interface after said cleaning procedure is completed an option for said user to request saving said optimized values with said adjusted optimized value; and storing said optimized values with said adjusted optimized value in a memory.

21. The system of claim 20, wherein said operations further comprise:

presenting on said user interface a cleaning result rating feature; and presenting on said user interface a recommendation of changing one or more of said optimized values if said user enters a rating of unsatisfactory.

22. The oven of claim 1, wherein, wherein each of said plurality of cleaning parameters is scalable and individually adjustable via the user interface by touch activation.

23. The method of claim 8, wherein, wherein each of said plurality of cleaning parameters is scalable and individually adjustable via the user interface by touch activation.

24. The system of claim 15, wherein, wherein each of said plurality of cleaning parameters is scalable and individually adjustable via the user interface by touch activation.

* * * * *